US008439198B2

(12) United States Patent
Hines

(10) Patent No.: US 8,439,198 B2
(45) Date of Patent: May 14, 2013

(54) BLANK

(75) Inventor: Aden Hines, Mona Vale (AU)

(73) Assignee: Aden Hines (AU)

( * ) Notice: Subject to any disclaimer, the term of this patent is extended or adjusted under 35 U.S.C. 154(b) by 177 days.

(21) Appl. No.: 13/059,637

(22) PCT Filed: Aug. 18, 2008

(86) PCT No.: PCT/AU2008/001208

§ 371 (c)(1),
(2), (4) Date: Feb. 17, 2011

(87) PCT Pub. No.: WO2009/023912

PCT Pub. Date: Feb. 26, 2009

(65) Prior Publication Data

US 2011/0147379 A1 Jun. 23, 2011

(30) Foreign Application Priority Data

Aug. 17, 2007 (AU) ..... 2007904454

(51) Int. Cl.
*B65D 73/00* (2006.01)

(52) U.S. Cl.
USPC ..... 206/476; 220/62; 220/694; 220/737; 206/146; 206/147; 206/149; 206/562; 206/486

(58) Field of Classification Search ..... 206/145–147, 206/149, 152, 161, 476, 495, 486, 562, 563, 206/32, 6; 220/62, 737, 694
See application file for complete search history.

(56) References Cited

U.S. PATENT DOCUMENTS

| | | | | |
|---|---|---|---|---|
| 3,139,255 | A * | 6/1964 | Palm | 248/150 |
| 4,905,947 | A * | 3/1990 | Henne et al. | 248/174 |
| 5,094,347 | A * | 3/1992 | Schuster | 206/434 |
| 5,778,450 | A | 7/1998 | Hagestad et al. | |
| 5,799,794 | A * | 9/1998 | Whitnell | 206/562 |
| 6,401,927 | B1 * | 6/2002 | Sorensen et al. | 206/562 |

FOREIGN PATENT DOCUMENTS

| | | |
|---|---|---|
| EP | 1 826 135 | 8/2007 |
| GB | 254533 | 7/1926 |
| JP | 09-095326 | 4/1997 |

* cited by examiner

*Primary Examiner* — J. Gregory Pickett
*Assistant Examiner* — Raven Collins
(74) *Attorney, Agent, or Firm* — Knobbe, Martens, Olson & Bear, LLP

(57) ABSTRACT

A blank of cardboard or plastics, the blank comprising a transverse fold line dividing the blank into a bearing portion and a support portion, the bearing portion having an aperture to accommodate the neck of a bottle or wall of a drinking glass or cup, the support portion being foldable under the bearing portion and terminating in at least one leg which is foldable relative to the support portion and arranged to co-operate with an underside of the bearing portion and to bear against a side of the neck or wall of the bottle or glass whereby the bearing portion is supported to extend laterally from the bottle or glass.

12 Claims, 10 Drawing Sheets

BASE PLAN VIEW

BLANK

REFERENCE TO RELATED APPLICATIONS

This application is the U.S. National Phase of International Application PCT/AU2008/001208, filed Aug. 18, 2008, and claims priority to Australian Patent Application No. 2007904454, filed Aug. 17, 2007. Each of the priority applications is hereby incorporated by reference in its entirety.

TECHNICAL FIELD

This invention relates to a blank which can be formed into a plate that can be suspended from a glass or bottle.

BACKGROUND

At social functions such as cocktail parties and business meetings, there is often a need for attendees to stand whilst eating and drinking. This need requires a degree of dexterity enabling the attendee whilst standing to hold and eat from a plate of food and to hold a glass or bottle whilst at the same time mingle in a crowded room. There have been many proposals in the past of devices that aid the challenges of eating and drinking whilst standing. There have been proposals to suspend plates from glasses and bottles and, in turn, proposals to suspend glasses from plates. These past proposals vary in complexity and cost.

This invention is concerned with a simple, cheap and disposable solution to these problems.

SUMMARY OF THE DISCLOSURE

According to one aspect of the present disclosure there is provided a blank of cardboard or plastics, the blank comprising a transverse fold line dividing the blank into a bearing portion and a support portion, the bearing portion having an aperture to accommodate the neck of a bottle or wall of a drinking glass or cup, the support portion being foldable under the bearing portion and terminating in at least one leg which is foldable relative to the support portion and arranged to co-operate with an underside of the bearing portion and to bear against a side of the neck or wall of the bottle or glass whereby the bearing portion is supported to extend laterally from the bottle or glass.

In one form, the blank comprises an aperture tab on an end of the at least one leg for insertion in the aperture. This may facilitate the co-operation of the at least one leg with the underside of the bearing portion.

In one form, the at least one leg is foldable on the support portion on a v-shaped fold line.

In one form, the support portion terminates in a slit which defines two said legs which are foldable relative to the support portion.

In one form, the support portion comprises two said tabs, each tab being associated with a respective said leg.

In one form, the at least one leg terminates in foldable slit tabs which are adapted to engage appropriately positioned slits in the bearing portion. This may facilitate said co-operation with the underside of the bearing portion.

The bearing portion may include a recess. In one form, the recess is formed by depressing a section of the bearing portion toward the support portion. In one form the bearing portion includes a flap section extending from a transverse fold line in the bearing portion, the flap having an internal transverse fold line separating a wall portion and a flap portion, the flap being adapted to be depressed toward the support portion.

In one form, the blank is formed of cardboard which forms part of a carton for beer or soft drink. In one form score lines are provided around the periphery of the blank to enable removal of the blank from the carton.

According to another aspect there is provided a blank of cardboard or plastics, the blank being elongate with a transverse fold line dividing the blank into a bearing portion and a support portion, the bearing portion having an aperture to accommodate the neck of a bottle or wall of a drinking glass or cup, the support portion being foldable under the bearing portion and terminating in a slit which defines legs which are foldable relative to the support portion to clip against the underside of the bearing portion on either side of the neck or wall of the bottle or glass whereby the bearing portion is supported to extend laterally from the bottle or glass.

In one form, the legs terminate in foldable tabs which are adapted to engage appropriately positions slits in the bearing portion.

In one form, the bearing portion further includes a tab extending from a lateral fold line, the tab being depressable toward the support portion to form the base and one wall of a recess in the bearing portion.

BRIEF DESCRIPTION OF THE DRAWINGS

Embodiments of the present invention will now be described by way of example only with reference to the accompanying drawings in which.

DETAILED DESCRIPTION OF EMBODIMENTS

Referring to FIGS. 1 through 4, disclosed is a blank 10 which is constructed of card, for example corrugated cardboard, or thin plastics. The blank 10 has a series of fold lines and slits or cuts to allow the blank 10 to be folded into a plate that can be suspended from the neck of a bottle. The material that is used to make the blank 10 may be sufficiently rigid to support a small load in use, such as food.

Figure 1:
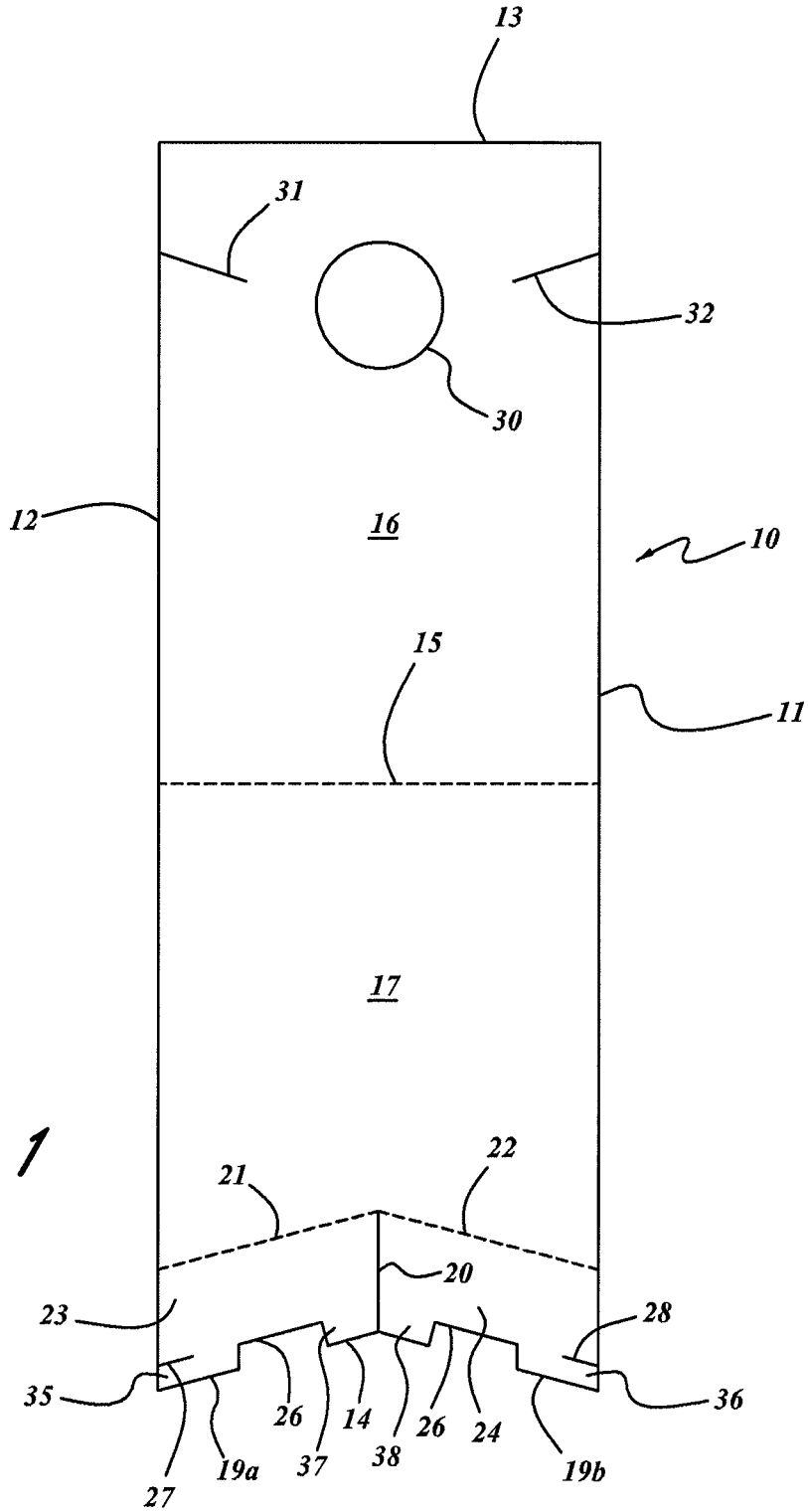
FIG. 1 is a plan view of a blank.

The blank 10 is of substantially rectangular form having longer sides 11 and 12 and shorter sides 13 and 14. A transverse fold line 15 extends across the middle of the blank as shown in FIG. 1 and divides the blank into a substantially planar bearing portion 16 and a support portion 17. The end of the support portion 17 terminates in a profiled edge which is split into two portions 19*a* and 19*b* by a centrally positioned slit 20 which extends longitudinally of the blank. A pair of v-shaped, or tapered fold lines 21, 22 extends from the longer edges of the blank to the base of the slit 20 as shown in FIG. 1 and the slit 20 and fold lines 21, 22 define two legs 23 and 24. The profiled end of each leg includes a substantially rectangular cut-out 26 and a small lateral slit 27, 28 is positioned on the edge of each leg 23, 24 inwardly of the free edge.

The bearing portion 16 has a centrally positioned circular aperture 30 positioned adjacent one end 13 and a pair of slits 31, 32 extending from the edges of the blank at an incline to that edge towards the aperture 30. It will be understood that in alternative embodiments, the aperture may be of a shape other than circular, and/or may be at an edge of the bearing portion 16, such that it is open at the bearing portion edge.

Figure 2:
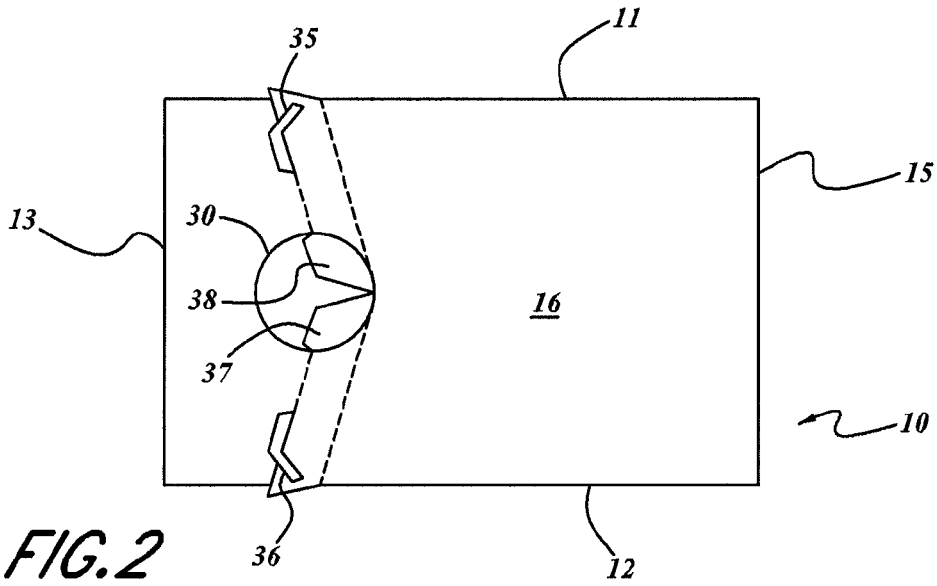
FIG. 2 is a plan view of the blank when folded.
Figure 4:
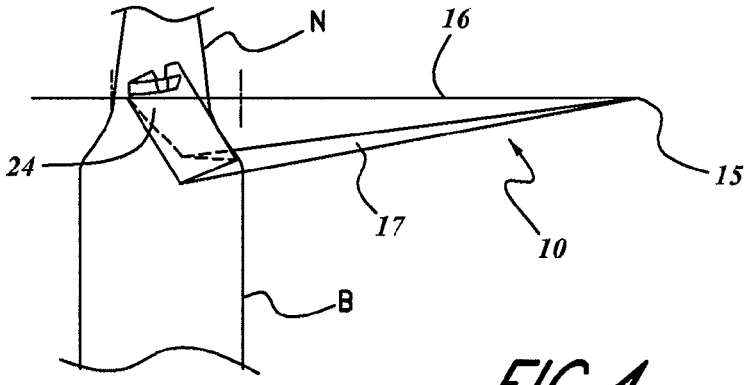
FIG. 4 is a side elevational view of the blank when folded and secured to the neck of a bottle.

The fold line 15 allows the blank 10 to be folded in half with the support portion 17 extending underneath the bearing portion 16. The central slit 20 and fold lines 21, 22 also allow the legs 23, 24 to be folded to project upwardly as shown in FIG. 4. The slits 27, 28 define small rectangular slit tabs 35, 36 which are shown in FIGS. 2 and 4 to allow the free ends of the legs 23, 24 to engage the underside of the bearing portion 16 via the inclined slits 31, 32. Aperture tabs 37, 38 are also defined on the end of respective legs 23, 24 for insertion into the aperture 30 when in use.

Thus in use the blank 10 is folded about the central fold line 15 and the legs 23, 24 turn upwardly as shown in FIG. 4. The aperture tabs 37, 38 are located in the aperture 30 and the slit tabs 35,36 are located in the slits 27, 28. The folded blank 10 can then be placed on the top of a bottle B by putting the head and neck N of the bottle through the aperture 30 until the aperture rests against the bottleneck N. At the same time, the upturned legs 23, 24 are positioned on the neck N of the bottle B to loosely engage the bottle in the manner shown in FIG. 4.

Figure 3:
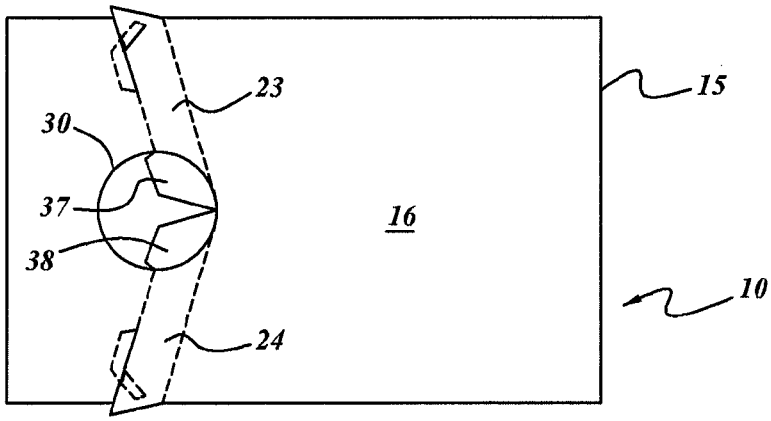
FIG. 3 is an underside view of the folded blank.

Several features of the embodiment contribute to maintaining the in use folded state of the blank, such as illustrated in FIGS. 2 to 4. For instance, when the blank 10 is in place on the bottle neck N, the aperture tabs 37, 38 are pushed against the aperture 30. Also, in use, given the gravitational downward pressure of the folded blank 10 on the bottle neck N, the legs 23, 24 are forced apart on the neck N, which further wedges the tabs 37, 38 against the aperture 30. The tapered configuration of the fold lines 21, 22 defining the legs 23, 24 further aid in forcing the legs 23, 24 apart on the bottle neck N. The slit tabs 35, 36, when in position in the slits 27, 28, also contribute to maintain the shape of the blank in its in use folded state. Also, given the distance from the fold line 15 to the apex where the fold lines 21, 22 meet, compared to the distance from the fold line 15 to the nearest edge of the aperture 30, is the same or shorter, this means the angle of the legs 23, 24 in use with respect to the bearing portion 16 is such that the legs can approximate the relatively conical shape of a bottle neck N.

The location of the blank 10 on the bottle B provides cantilevered support whereby the bearing portion 16 can support a load and the inherent rigidity and strength of the cardboard together with the structure associated with the support defined by the support structure 17 allows the bearing surface 16 to extend substantially horizontally to the bottle B as shown in FIG. 4. The blank 10 can be simply attached to a bottle and then a person can hold the bottle whilst at the same time supporting a small load on the bearing surface 16. In this manner, a participant of a cocktail party has the opportunity of holding a drink in one hand whilst at the same time supporting small portions of food on the blank 10, the food being available for access by the participant's other hand.

Figure 5:
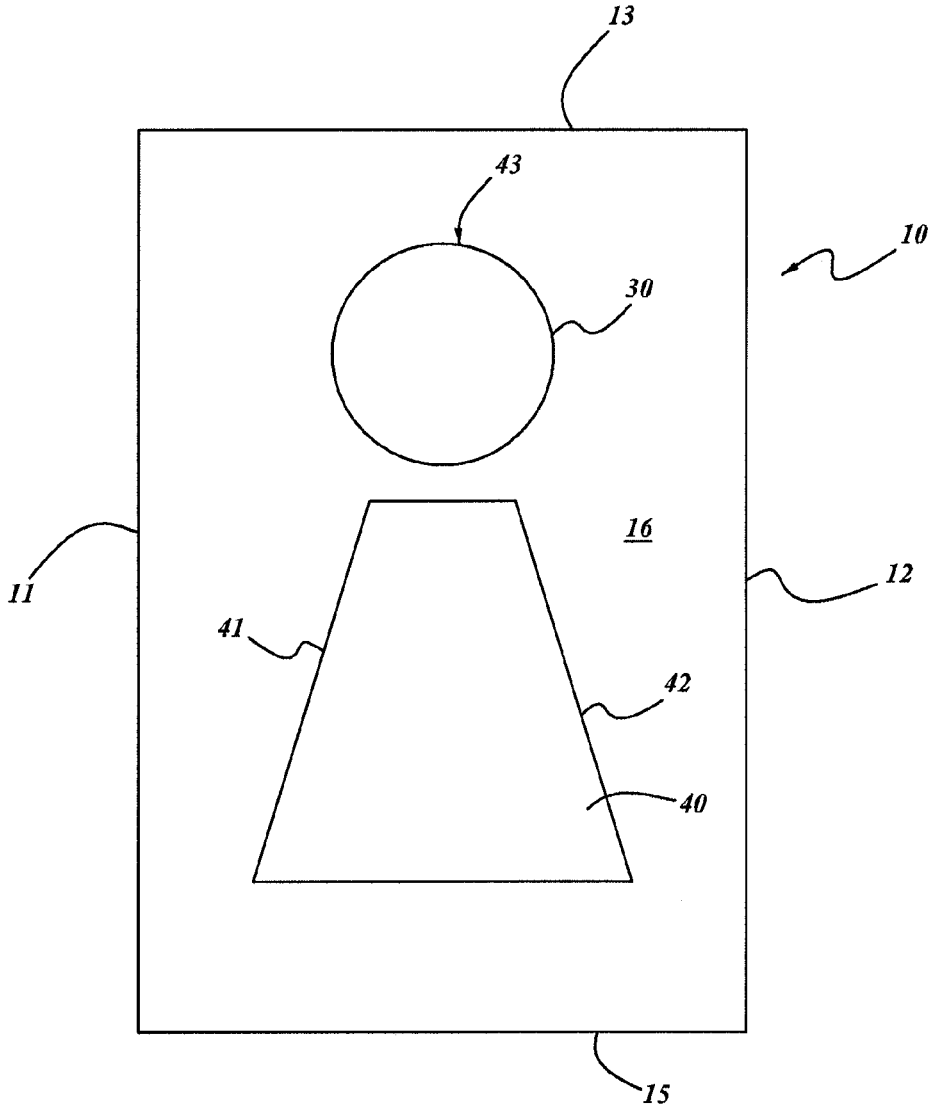
FIGS. 5 and 6 are plan views of alternative forms of one portion of the blank.

In the embodiment shown in FIG. 5, where like reference numerals denote like parts, the bearing portion 16 of the blank 10 is shown having a shallow recess 40 of trapezoidal shape. The sides 41, 42 of the recess 40 are derived from lines directed from a bearing point 43 on the aperture 30 opposite the fold line 15, at which the load from the bearing portion 16 bears against the bottle neck N. This arrangement further strengthens the bearing portion 16. It is understood that the cardboard could be multi-layered and the shallow recess 40 would be formed by removing the top one or two layers from multilayered, corrugated structure. Also, accessories, such as additional food plates or bowls, could be configured to have bases of a complementary shape and similar size to the recess 40, such that they are seated stably in the recess 40.

Figure 6:
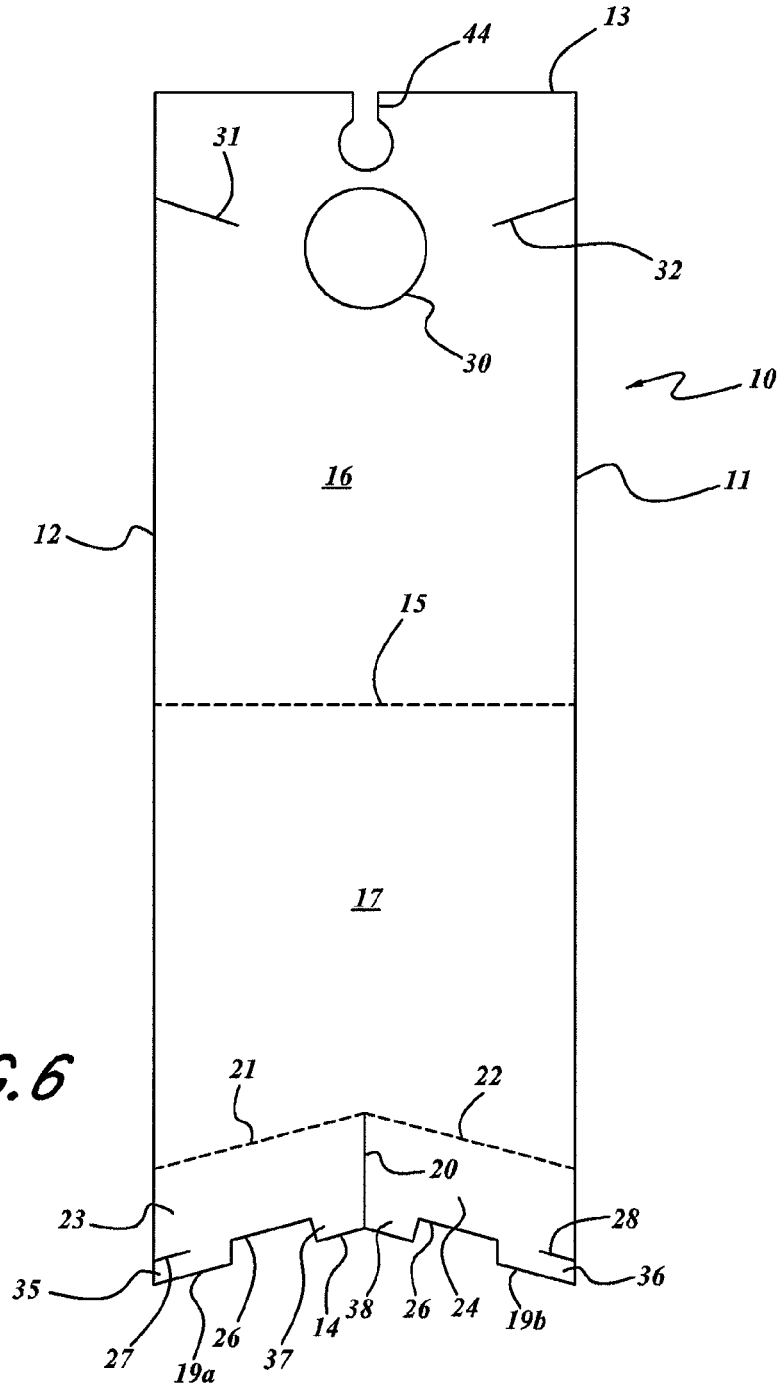
Figure 7:
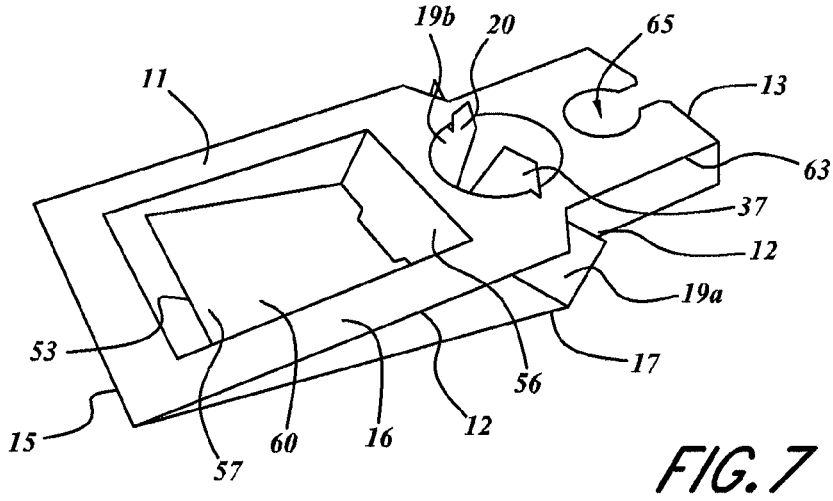
FIG. 7 is a perspective view of a second embodiment of the blank in assembled state.
Figure 8:
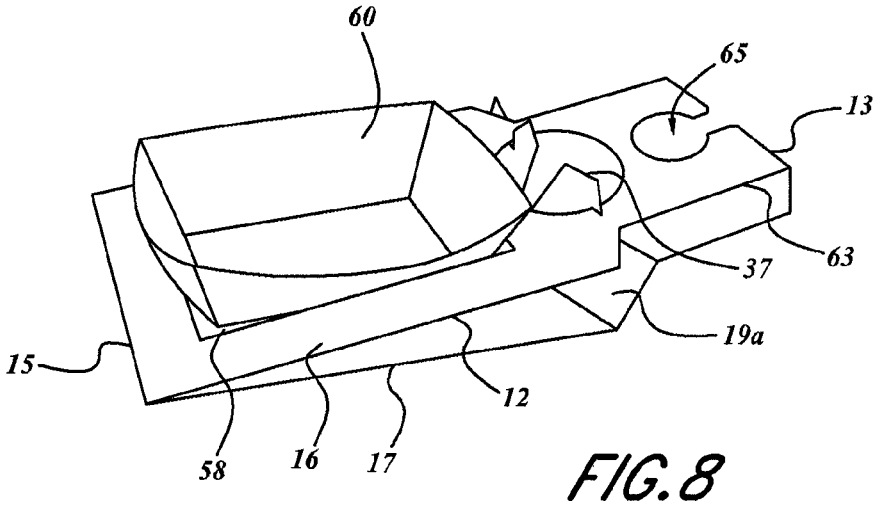
FIG. 8 is a perspective view of the blank of FIG. 7, with tray.
Figure 9:
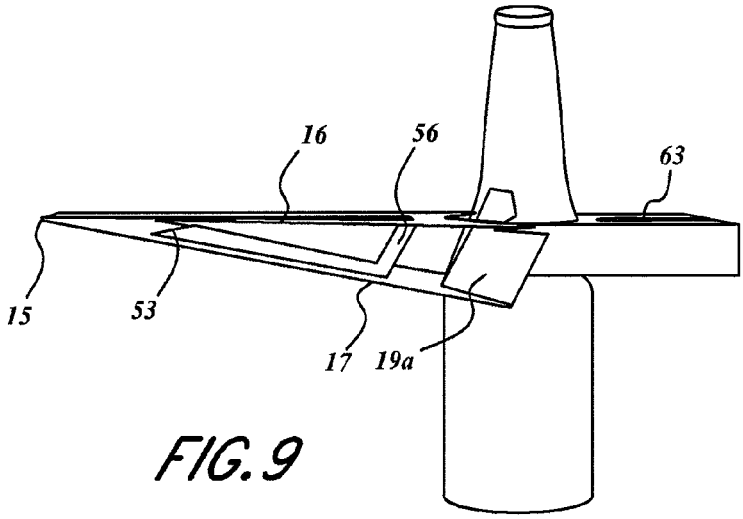
FIG. 9 is a side view of the blank of FIG. 7.
Figure 10:
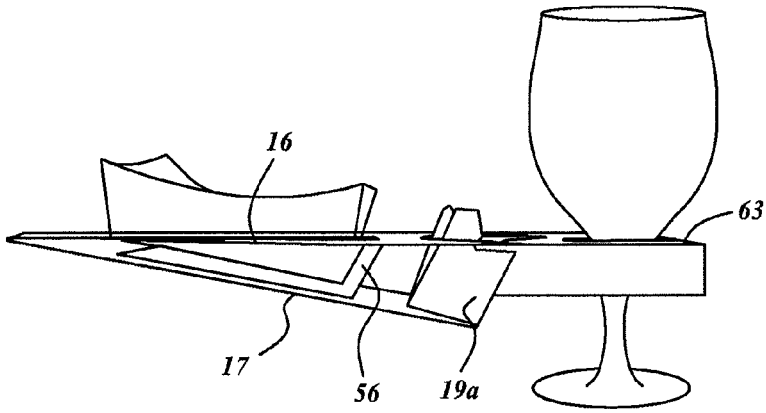
FIG. 10 is a side view of the blank of FIG. 7 with tray.
Figure 11:
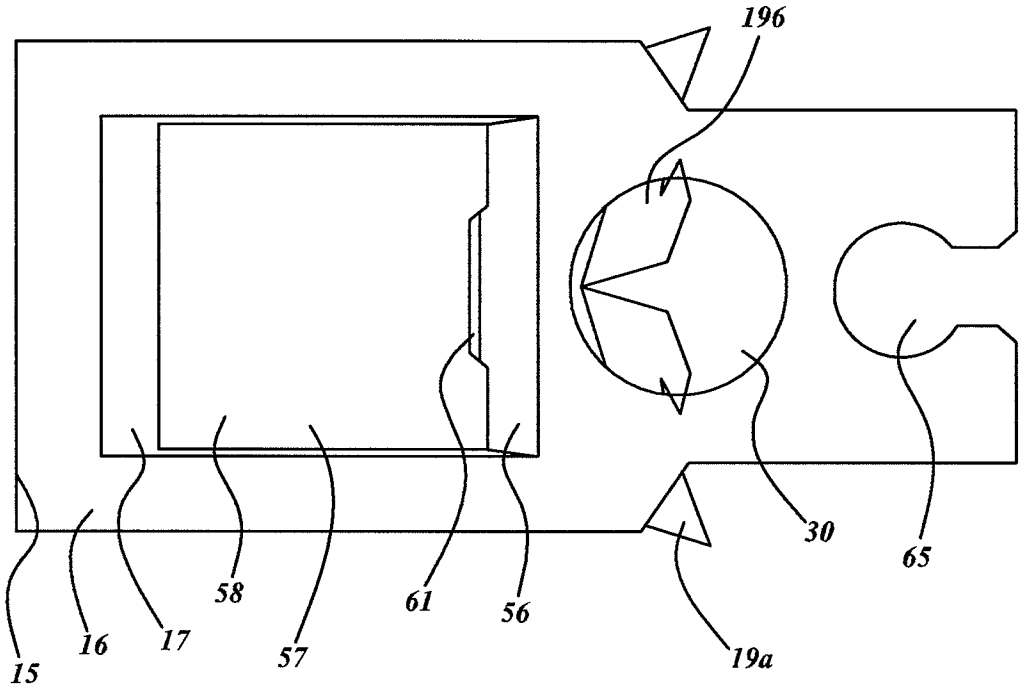
FIG. 11 is a top plan view of the blank of FIG. 7.
Figure 12:
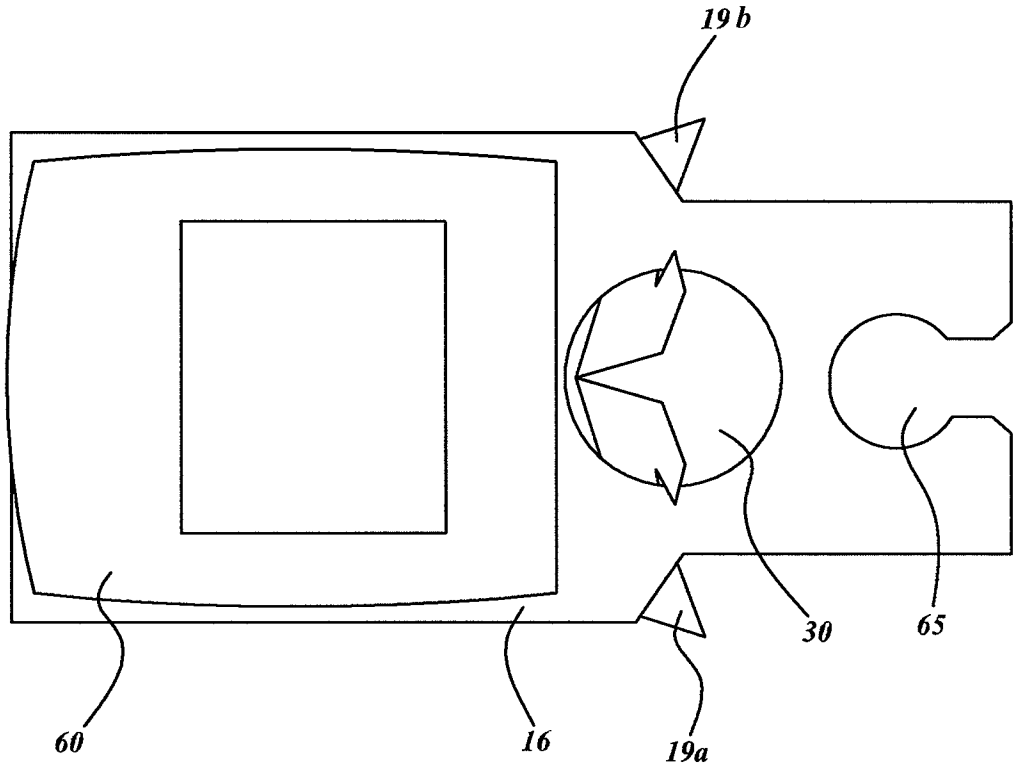
FIG. 12 is a top plan view of the blank of FIG. 7, with tray.
Figure 13:
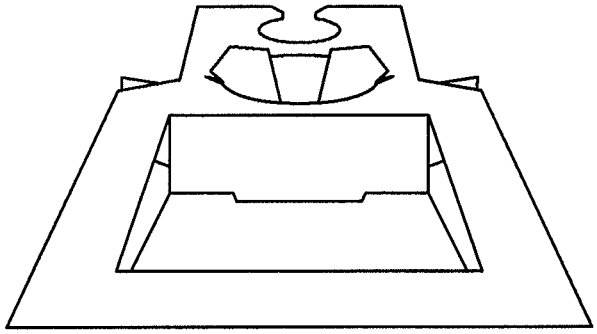
FIG. 13 is a front view of the blank of FIG. 7.
Figure 14:
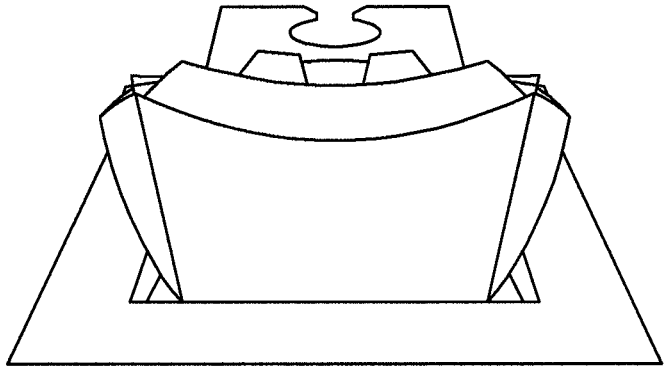
FIG. 14 is a front view of the blank of FIG. 7 with tray.
Figure 15:
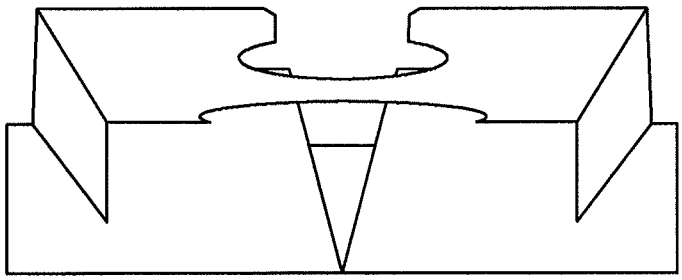
FIG. 15 is a rear view of the blank of FIG. 7.
Figure 16:
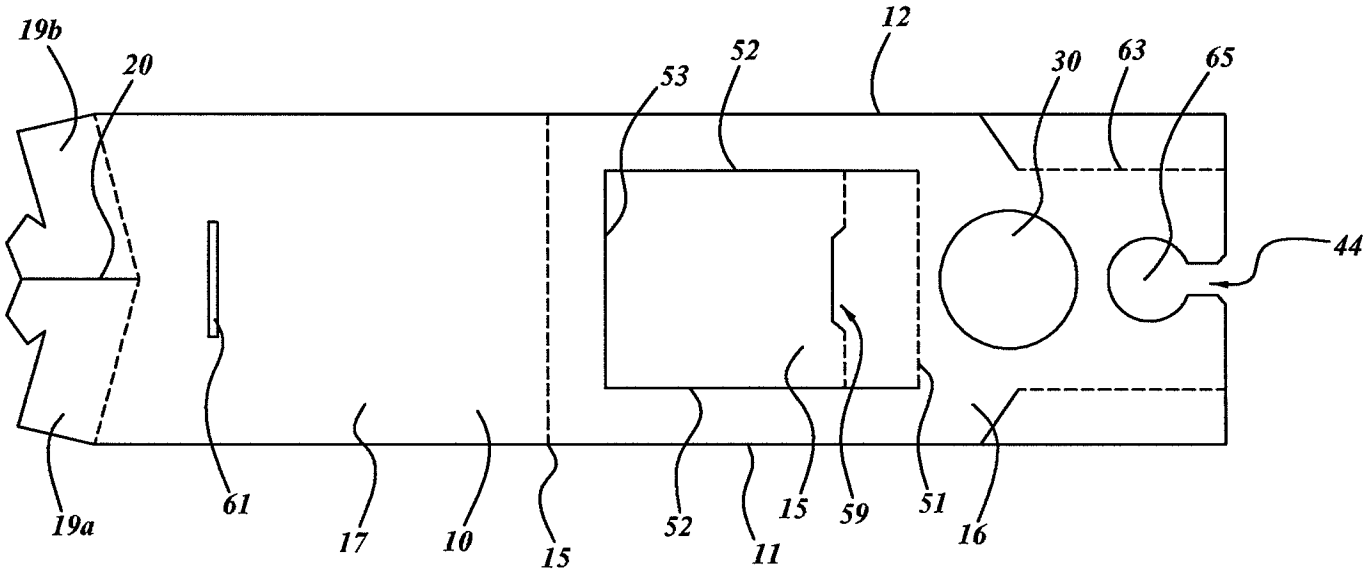
FIG. 16 is a plan view of the blank of FIG. 7 in disassembled state.

In another embodiment illustrated in FIG. 6, where like reference numerals denote like parts, the bearing portion 16 may further include a slot 44 for receiving a wine or similar stemmed glass therein, where the weight of the glass is supported by the blank. In this embodiment, the blank 10 itself could be held directly by the user to support both the blank and food thereupon, and the stemmed glass.

In another embodiment shown in FIGS. 7 to 16, the blank 10 is of substantially rectangular form having longer sides 11 and 12 and shorter sides 13 and 14. A transverse fold line 15 extends across the middle of the blank as shown in FIG. 1 and divides the blank into a substantially planar bearing portion 16 and a support portion 17.

The end of the support portion 17 terminates in a profiled edge which is split into two portions 19*a* and 19*b* by a centrally positioned slit 20 which extends longitudinally of the blank. A pair of v-shaped, or tapered fold lines 21, 22 extends from the longer edges of the blank to the base of the slit 20 as shown in FIG. 1 and the slit 20 and fold lines 21, 22 define two legs 23 and 24. The profiled end of each leg includes a polygonal tab 26*a*. The support portion 17 further includes a slot 61.

The bearing portion 16 of the blank 10 includes a tab 50 which extends from a transverse fold line 51. Transverse fold line 51 is scored. The tab 50 is defined by two longitudinal slits 52 and one lateral slit 53. The tab includes an internal fold line 55. In use the tab 50 is folded at internal fold line 55 to form a wall portion 56 and a flap portion 57. The flap portion 57 is depressed toward the support portion 17 to form the base of a recess 58 in the bearing portion 16. The wall portion 56 includes a protrusion 59 which can be inserted into a slot 61 in the support portion 17. The wall portion 56 extends between the support portion 17 and the bearing portion 16.

The recess 58 is adapted to allow a tray 60 to be positioned thereon. The tray 60 is reusable and can be used to contain food or other items for carrying. The recess 58 allows for greater stability for items carried on the tray 60 or on the bearing portion 16.

The bearing portion 16 further includes two angled slits 62 which are oriented to slope toward the fold line 15. A longitudinal fold line 63 extends from each angled slit 62 to the end of the bearing portion 16. In use, the slit 62 and fold line 63 co-operate to form a flap which folds downwardly from the bearing portion 16 to bear against the legs 19 of the support portion. This adds rigidity and strength to the end of the bearing portion 16 which allows the bearing portion to better support a wine glass in wine glass cavity 65.

The location of the blank 10 on a bottle provides cantilevered support whereby the recess 58 in the bearing portion 16 or the bearing portion 16 can support a load. The inherent rigidity and strength of the cardboard together with the structure associated with the support defined by the support structure 17 allows the bearing surface 16 to extend at an angle to the bottle and allows the flap portion 57 of the bearing portion to align with the support portion 17 which is oriented by the bottle to be substantially horizontal.

In other embodiments, it is understood that the blank could carry suitably positioned advertising and it is further understood that the blank could form part of the side wall of a beer carton with the side wall being suitably perforated so that the blank can be popped out for use. Also in other embodiments, it will be understood that either or both of the aperture tabs 37, 38 or the slit tabs 35, 36 may be used to aid in maintaining the in use folded state of the blank 10.

Although the embodiment is described for use on the top of a bottle, particularly a beer bottle, or with a wine glass, it is understood that the blank could be modified to sit on other drinks containers such as glasses, cups or mugs. It is further understood that, whilst in the embodiment the bearing surface extends in a cantilevered fashion to one side of a bottle, the blank could be designed so that there is a bearing surface surrounding the neck of a bottle to provide an annular, arcuate, square, or other surface around the neck of a bottle.

The invention claimed is:

1. A blank of cardboard or plastics, the blank comprising a transverse fold line dividing the blank into a bearing portion and a support portion, the bearing portion having an aperture to accommodate the neck of a bottle or wall of a drinking glass or cup, the support portion being foldable under the bearing portion and terminating in at least one leg which is foldable relative to the support portion and arranged to co-operate with an underside of the bearing portion and to bear against a side of the neck of the bottle or wall of the drinking glass or cup whereby the bearing portion is supported to extend laterally from the bottle or glass or cup, the blank comprising an aperture tab on the end of the at least one leg for insertion in the aperture.

2. The blank of claim 1, wherein the at least one leg is foldable on the support portion on a v-shaped fold line.

3. The blank of claim 1, wherein the support portion terminates in a slit which defines two said legs which are foldable relative to the support portion.

4. The blank of claim 3, wherein the support portion comprises two said tabs, each tab being associated with a respective said leg.

5. The blank of claim 1, wherein the at least one leg terminates in foldable slit tabs which are adapted to engage appropriately positioned slits in the bearing portion.

6. The blank of claim 1, wherein the bearing portion includes a recess.

7. The blank of claim 6, wherein the recess is formed by depressing a section of the bearing portion toward the support portion.

8. The blank of claim 7, wherein the bearing portion includes a flap section extending from a transverse fold line in the bearing portion, the flap having an internal transverse fold line separating a wall portion and a flap portion, the flap being adapted to be depressed toward the support portion.

9. A carton for beer or soft drink comprising the blank of claim 1, wherein the blank is formed of cardboard.

10. The carton of claim 9, wherein score lines are provided around the periphery of the blank to enable removal of the blank from the carton.

11. A blank of cardboard or plastics, the blank being elongate with a transverse fold line dividing the blank into a bearing portion and a support portion, the bearing portion having an aperture to accommodate the neck of a bottle or wall of a drinking glass or cup, the support portion being foldable under the bearing portion and terminating in a slit which defines legs which are foldable relative to the support portion to clip against the underside of the bearing portion on either side of the neck of the bottle or wall of the drinking glass or cup whereby the bearing portion is supported to extend laterally from the bottle or glass or cup, and wherein the legs terminate in foldable slit tabs which are adapted to engage appropriately positioned slits in the bearing portion.

12. A blank as defined in claim 11, wherein the bearing portion further includes a tab extending from a lateral fold line, the tab being depressable toward the support portion to form the base and one wall of a recess in the bearing portion.

* * * * *